United States Patent [19]

Ikeda et al.

[11] Patent Number: 4,613,245

[45] Date of Patent: Sep. 23, 1986

[54] DEVICE FOR CONTROLLING THE CARRIAGE RETURN OF A LEAD SCREW DRIVEN PRINTING HEAD

[75] Inventors: Yoshiaki Ikeda; Yoshio Tamura; Masahiko Nanri; Yasuki Onizuka, all of Tokyo, Japan

[73] Assignee: Seikosha Co., Ltd., Tokyo, Japan

[21] Appl. No.: 638,751

[22] Filed: Aug. 8, 1984

[30] Foreign Application Priority Data

Aug. 22, 1983 [JP] Japan ..... 58-152786

[51] Int. Cl.[4] ..... B41J 19/68

[52] U.S. Cl. ..... 400/313; 400/317; 400/322; 400/328

[58] Field of Search ..... 400/34, 76, 313, 315, 400/317, 317.1, 323, 328, 283, 279, 315, 320, 322; 346/139 D

[56] References Cited

U.S. PATENT DOCUMENTS 3,628,645 12/1971 McFeaters et al. ..... 400/328

FOREIGN PATENT DOCUMENTS 58-36476 3/1983 Japan ..... 400/328

*Primary Examiner*—William Pieprz
*Assistant Examiner*—David A. Wiecking
*Attorney, Agent, or Firm*—Robert E. Burns; Emmanuel J. Lobato; Bruce L. Adams

[57] ABSTRACT

Disclosed is a travelling control of printing head in which when a printing head is to be returned to its home position, the printing head is returned in a selected one of two modes, the first mode being such that a lead screw is reversely rotated upon completion of a desired printing operation to cause the printing head to return to its home position through a first guide groove provided for the forward travelling of the printing head and the second mode being such that the lead screw is rotated forward even after the completion of the desired printing operation and the guide groove is changed from the first one to a second one which is provided only for the return travelling of the printing head and which has a pitch larger than that of the first one so that the printing head can be quickly returned to its home position at a speed higher than that in the forward travelling. Thus, the return mode can be selected such that the time required for the printing head to return to its home position in the selected mode is shorter than in the other mode.

8 Claims, 16 Drawing Figures

DEVICE FOR CONTROLLING THE CARRIAGE RETURN OF A LEAD SCREW DRIVEN PRINTING HEAD

BACKGROUND OF THE INVENTION

The present invention relates generally to a device for controlling the travelling of a printing head in a printer of the type in which the printing head is caused to travel in reciprocal directions perpendicular to the feeding direction of a recording medium, and more particularly, to a device for controlling the travelling of a printing head in a printer of the type in which the printing head is caused to reciprocate by a lead screw having a helical guide groove formed on its outer periphery.

A printer in which a printing head is caused to travel by a lead screw is known. In this known printer, the lead screw is provided on its outer periphery with a single helical guide groove and is forward/backward driven by an expensive stepping motor to cause the printing head to reciprocate along its travelling path. Another printer is also known in which a printing head is caused to reciprocate by a lead screw having a first guide groove for causing the printing head to move in the forward direction and a second guide groove for causing the printing head to move in the backward direction, the first and second guide grooves being wound in opposite directions to each other to intersect each other and being connected to each other at their opposite ends to form a closed loop. The first and second guide grooves both have the same pitch. The use of such a lead screw provides the advantage that the printing head can be reciprocated only by continuously rotating the lead screw in the same direction, so that an inexpensive motor can be employed. Although each of the prior art techniques as described above is suitable for a printer in which printing is made during each of the forward and backward travelling strokes, it is not suitable for a printer in which printing is made only during the forward travelling stroke for the following reason. That is, in each of the abovementioned two conventional printers, the time required for the backward travelling stroke in which no printing is made is equal to the time required for the forward travelling stroke in which printing is performed, so that the former is unnecessarily long and thus increases the time for the printing head to travel in one reciprocating cycle, thereby resulting in a reduction in the actual printing speed.

Accordingly, in a printer which performs a printing operation only during the forward travelling stroke of a printing head, in order to substantially increase the printing speed, there has been proposed an arrangement wherein the pitch guide groove of a for effecting the backward travelling stroke of the printing head is selected to be several times (for example twice) as large as that of another guide groove for effecting the forward travelling stroke of the printing head, the lead screw being continuously rotated in a fixed direction. By using such an improved lead screw, the time required for the printing head to return is shortened, resulting in a reduction in the time required for the printing head to complete one reciprocating cycle. However, this reduction in the time required for the printing head to make one reciprocating cycle, i.e. the increase in actual printing speed, is still insufficient. In printing data in a printer, there are a few cases where full characters are printed in each character line, while in many cases characters which are half or less in number in comparison with the full characters are printed in each character line. Even in the case where the last mentioned system is employed, the time required for the printing head to make one reciprocating cycle is constant regardless of the number of characters to be printed in the cycle, and consequently the actual printing speed is inferior to that of a printer of the type in which a printing head is returned by a return spring.

SUMMARY OF THE INVENTION

An object of the present invention is, therefore, to further improve the actual printing speed in a printer of the type in which a printing head is caused to reciprocate through a lead screw.

According to an aspect of the present invention, the printing head can be returned in a short time by selecting between first and second return modes, the first mode being such that a lead screw is reversely rotated upon completion of a desired printing operation to cause the printing head to return to its home position through a first guide groove provided for the forward travelling of the printing head and the second mode being such that the lead screw is rotated forward even after the completion of the desired printing operation and the guide groove is changed from the first one to a second one which is provided only for the return travelling of the printing head and which has a pitch larger than that of the first one so that the printing head can be quickly returned to its home position at a speed higher than that in the forward travelling. Thus, the return mode is selected such that the time required for the printing head to return to its home position in the selected mode is shorter than in the other mode.

Other objects and features of the present invention will be apparent from the following description taken in connection with the accompanying drawing.

DETAILED DESCRIPTION OF THE PREFERRED EMBODIMENT

Figure 8:
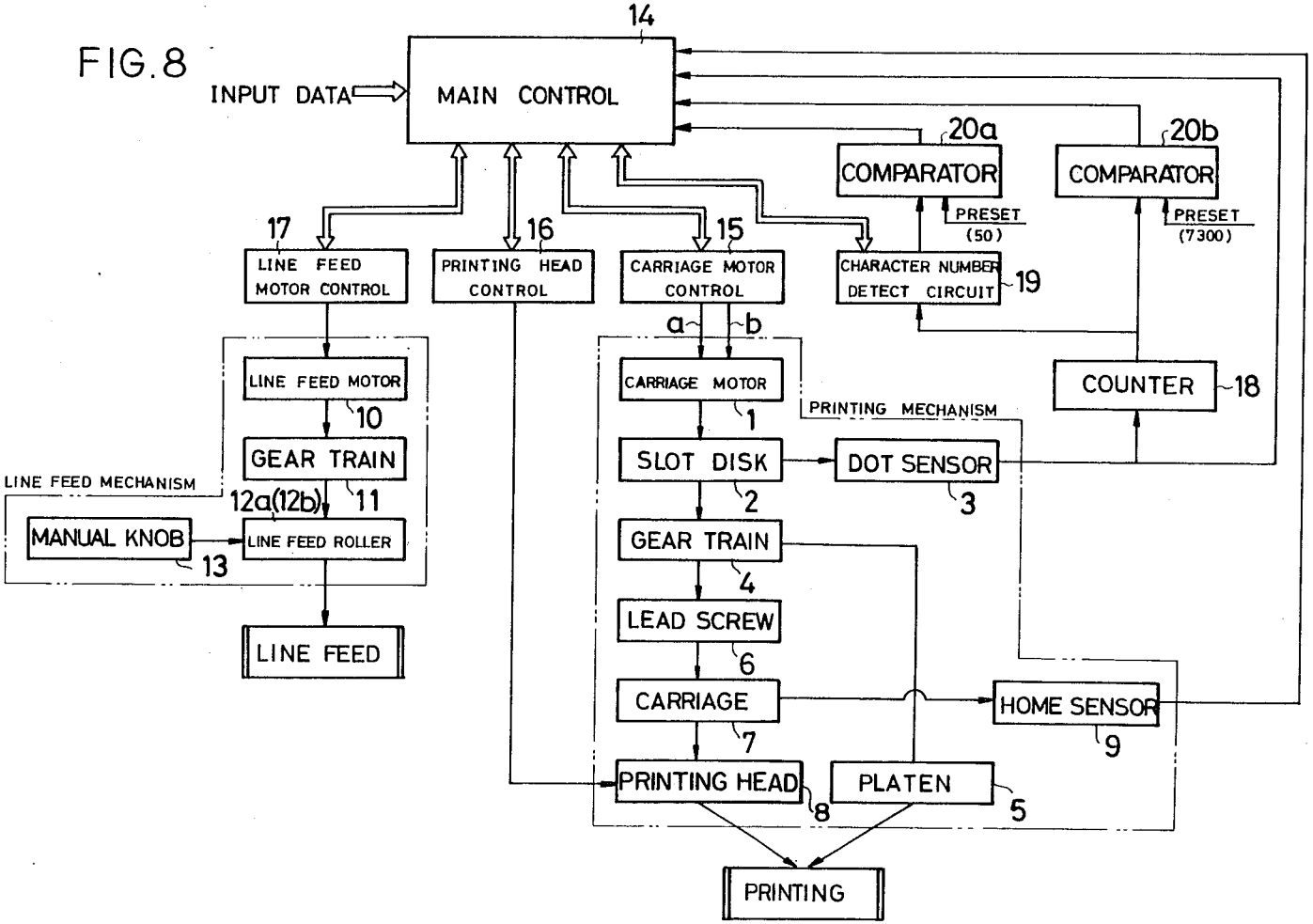
FIG. 8 is a block diagram showing the arrangement of the above-mentioned printer.

In a preferred embodiment described hereunder, the present invention is applied to a cross-hammer dot printer capable of printing 80 characters per each printing line. A block diagram of the embodiment is shown in FIG. 8.

The printing mechanism comprises a carriage motor 1, a slotted disk 2, a dot sensor 3, a gear train 4, a platen 5, a shaft in the form of a lead screw 6, a carriage 7, a printing head 8, a home sensor 9, etc. A line feed mechanism comprises a line feed motor 10, a gear train 11, paper feed rollers 12*a* and 12*b*, a manually operable knob 13, etc. A central processing unit CPU is constituted by a microprocessor comprising a main control 14, a carriage motor control 15, a printing head control 16, a line feed motor control 17, a counter 18, a printed-character number detecting circuit 19, and comparators 20*a* and 20*b*, the CPU being arranged to operate in accordance with the flowcharts shown in FIGS. 9 to 11.

Figure 1:
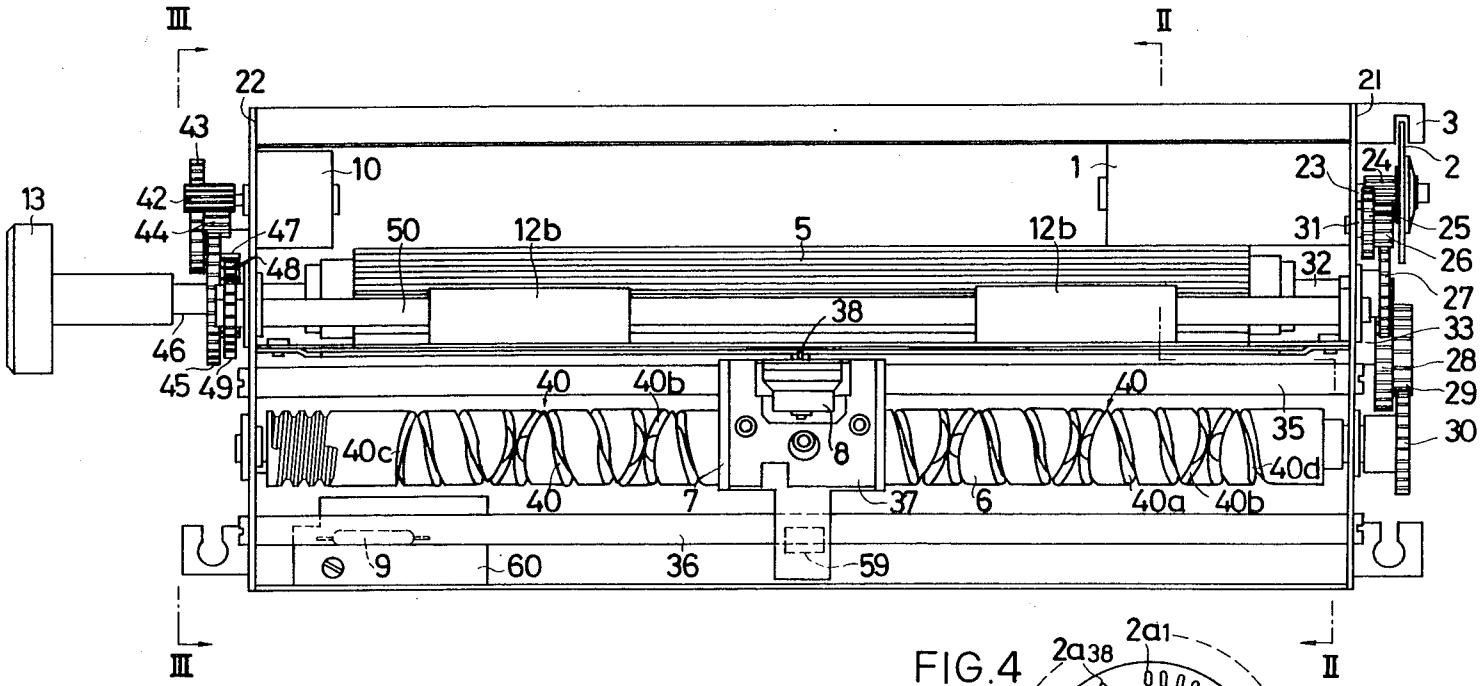
FIG. 1 is a plan of a cross-hammer dot printer to which the present invention is applied.
Figure 2:
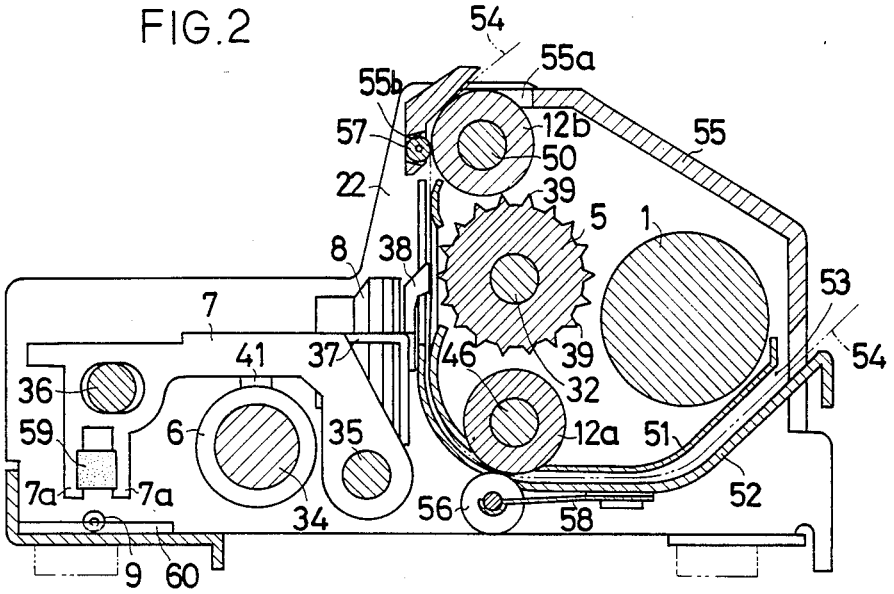
FIG. 2 is an enlarged cross-section along II—II line in FIG. 1.

Referring to FIGS. 1 and 2, the detail of the printing mechanism will be described.

In FIG. 1, side plates 21 and 22 are disposed in parallel to each other with a predetermined distance therebetween, and the platen 5 and the lead screw 6 are rotatably supported by the side plates 21 and 22. The reversible carriage motor 1 for driving the platen 5 and the lead screw 6 is mounted on the side plate 21. The revolution of the motor 1 is transmitted to a pinion 24 fixedly mounted on a motor shaft 24, a gear 25, a pinion 26, a platen gear 27, a gear 28, a pinion 29, and a lead screw gear 30. The gear 25 and the pinion 26 are integrally formed and rotatably supported by a shaft 31 secured to the side plate 21. The platen gear 27 is fixedly mounted on a projecting end portion of a shaft 32 of the platen 5. The gear 28 and the pinion 29 are integrally formed and rotatably supported by a shaft 33 secured to the side plate 21. The lead screw gear 30 is fixedly mounted on a projecting end portion of a shaft 34 of the lead screw 6.

In FIGS. 1 and 2, above the lead screw 6, the carriage 7 is slidably supported by a pair of guide shafts 35 and 36 provided between the side plates 21 and 22. The printing head 8 is mounted on the carriage 7 through a head mount 37. The printing head 8 has a magnetically operable printing hammer 38 which is positioned opposite to the platen 5. The platen 5 is provided with a plurality of (eighteen in this embodiment) ridges 39 equidistantly formed on its outer peripheral surface, the ridges 39 extending in parallel with the axial direction of the platen 5. The lead screw 6 is provided with a guide groove 40 formed in its outer peripheral surface. An engagement member 41 hangs down from the lower surface of the carriage 7 and slidably engages with the guide groove 40.

Figure 12:
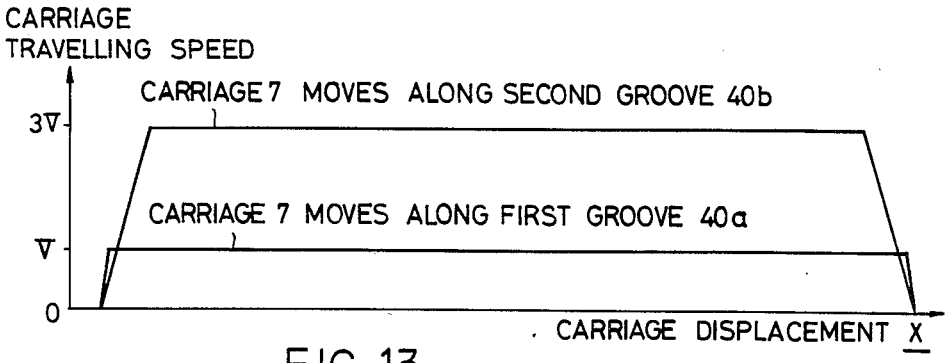
FIG. 12 is a diagram showing the relation between the displacement and travelling speed of the carriage.

The guide groove 40 has a first guide groove 40*a* and a second guide groove 40*b*. The first and second guide grooves 40*a* and 40*b* are formed such that they are wound in opposite directions to each other so as to intersect each other and are connected to each other at the respective opposite end portions 40*c* and 40*d*. The second groove 40*b* has a pitch larger than that of the first groove 40*a* a, and in this embodiment the respective pitches of the second and first grooves 40*b* and 40*a* are selected to be 3:1. Thus, although the carriage 7 is reciprocated left and right by the rotation of the lead screw 6, the travelling speed is different between the forward and backward directions. That is, the travelling speed effected by the second guide groove 40*b* is three times as fast as that effected by first guide groove 40*a*. FIG. 12 shows the relation between the displacement and travelling speed of the carriage 7.

Figure 3:
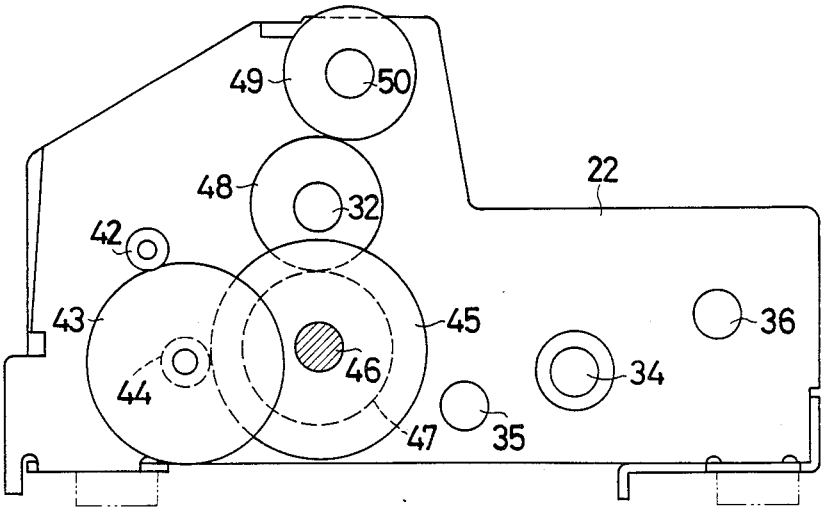
FIG. 3 is an enlarged cross-section along III—III line in FIG. 1.

The line feed motor 10 is mounted on the side plate 22 as shown in FIG. 1. The rotation of the line feed motor 10 is transmitted to a line feed gear 45 through a motor pinion 42, a gear 43, and a pinion 44 integrally formed with the gear 43, as shown in FIG. 3, so as to drive a paper feed shaft 46. The rotation of the gear 45 is transmitted to a line feed gear 49 through a gear 47 integrally formed with the gear 45 and an idler 48 so as to drive a line feed shaft 50. The manually operable knob 13 is mounted on the line feed shaft 46. As shown in FIG. 2, the line feed shafts 46 and 50 are respectively disposed above and below the platen 5, and the line feed rollers 12*a* and 2*b* are fixedly attached to the respective shafts 46 and 50. A recording medium 54 inserted through an inlet opening 53 is passed through a passageway between guide plates 51 and 2, so as to lead between the platen 5 and the printing head 8, and discharged out of a discharging opening 55*a* of a cover 55. Pinch rollers 56 and 57 are provided for pressing the recording medium 54 against the line feed rollers 12*a* and 12*b*. The pinch roller 56 is rotatably supported through a spring plate 58 attached on the lower surface of the guide plate 52 and the pinch roller 57 is rotatably supported in a recess portion 55*b* in the front wall of the cover 55.

Figure 4:
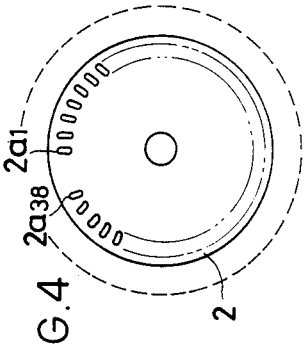
FIG. 4 is an enlarged front view of a slotted disk.
Figure 5:
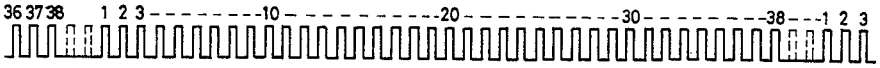
FIG. 5 is a view showing output pulses of a dot sensor.
Figure 6:
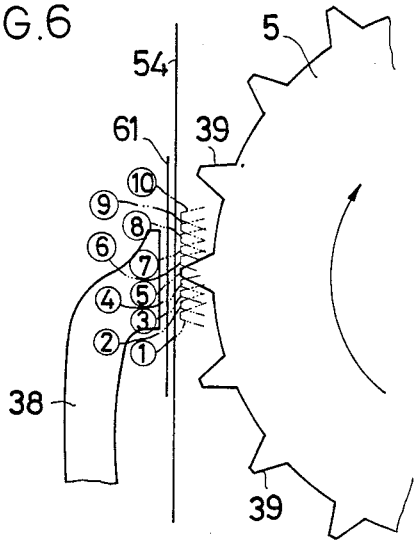
FIG. 6 is an enlarged side view showing the relation of opposition between a printing hammer and a platen.
Figure 7:
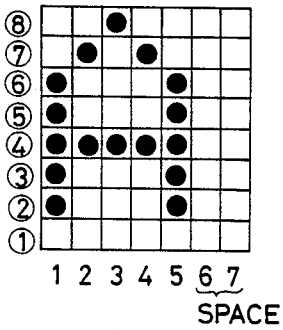
FIG. 7 is an enlarged view showing an example of a dot matrix character formed in the printer mentioned above.

Further in FIG. 2, two legs 7*a* and 7*a* are integrally formed with the carriage 7, and a permanent magnet 59 is provided between the legs 7*a* and 7*a*. Below the legs 7*a* and 7*a*, the home sensor 9 is mounted on a circuit board 60 (a reed switch is employed as the home sensor in this embodiment). As seen in FIG. 1, the home sensor 9 is disposed close to the left side plate 22 to detect whether the carriage 7 is in its left end home position or not. As shown in FIG. 4, the slotted disk 2 which cooperates with the dot sensor 3 is provided with numbers of slots 2*a* formed at its outer periphery. In this embodiment, 38 slots $2a_1$–$2a_{38}$ are formed at a distance of 9°(=360°/ 40) and a gap which corresponds to two slots is formed between the slots $2a_1$, $2a_{38}$. Thus, the dot sensor 3 produces print timing pulses (FIG. 5) for actuating the printing hammer 38, in synchronism with the position of the ridges 39 of the platen 5, as the slotted disk 2 rotates. FIG. 6 shows the relation between the ridges 39 of the platen 5 and the printing hammer 38. The 1st to the 10th pulses, the 11th to the 20th pulses, and the 21st to the 30th pulses, are respectively generated when the corresponding ridges 39 are in the positions ① ~ ⑩ in FIG. 6 and the 31st to the 38th pulses are generated when the corresponding ridges 39 are in the position ① ~ ⑧. In this embodiment, a dot matrix character, symbol or the like is formed in the grid positions constituted by 8 columns and 7 rows (including two rows for the space between characters) and the positions ①~⑧ in FIG. 6 correspond to the positions ①~⑧ in FIG. 7. Although the 9th, the 10th, the 19th, the 20th, the 29th, and the 30th pulses generated at the positions ⑨ and ⑩ in FIG. 6 are not used in the actual printing operation, the 1st to the 10th pulses, the 11th to the 20th pulses, the 21st to the 30th pulses, the 31st to 38th pulses respectively correspond to one row of a certain dot matrix.

Figure 9:
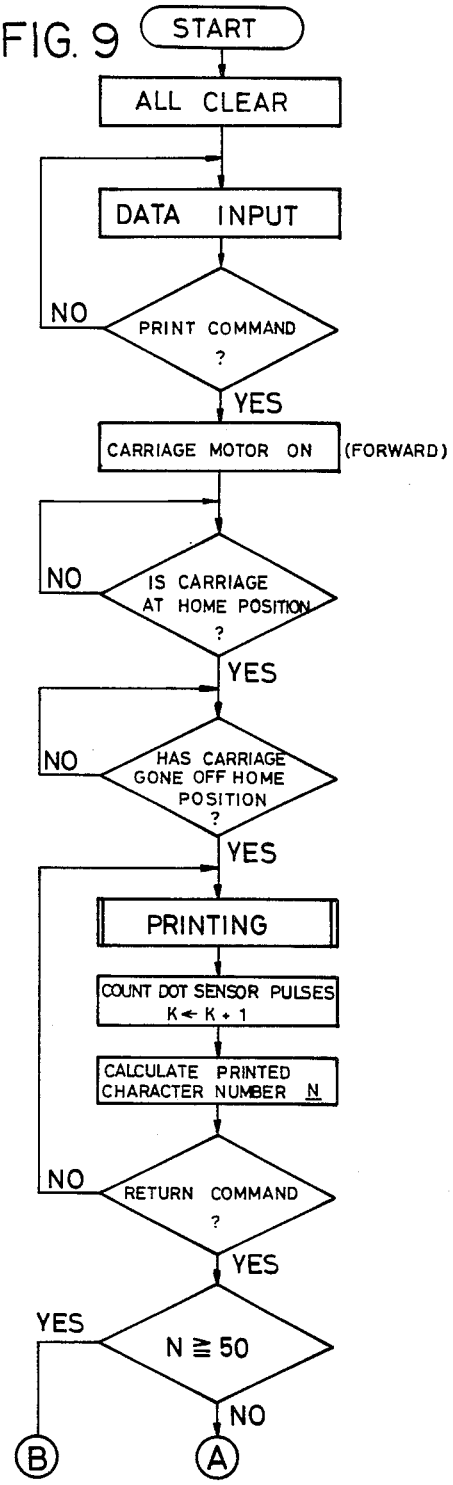
FIG. 9 is a flow chart of the printing operation.
Figure 10:
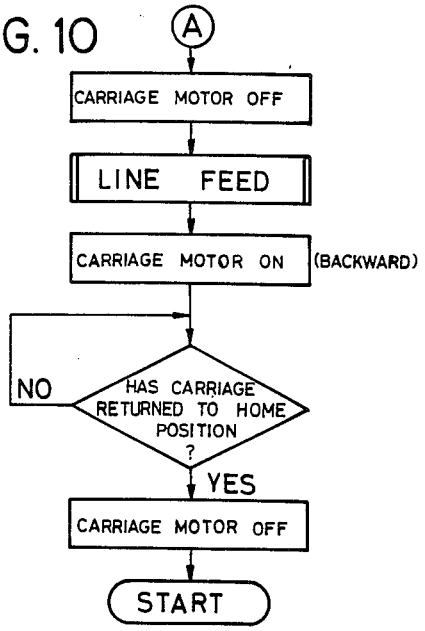
FIG. 10 is a flow chart of the carriage return operation when the number of characters to be printed is less than a preset value.
Figure 11:
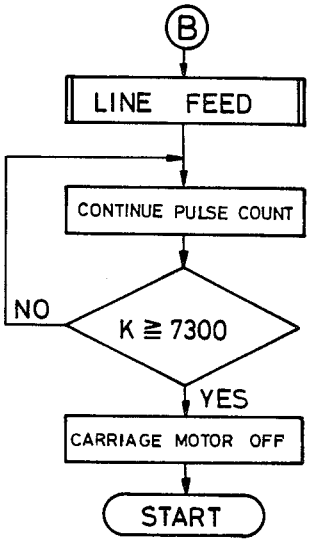
FIG. 11 is a flow chart of the carriage return operation when the number of characters to be printed is equal to or larger than the preset value.

The operation of the printer according to the present invention is controlled in accordance with the flow charts of FIGS. 9 to 11.

Figure 13:
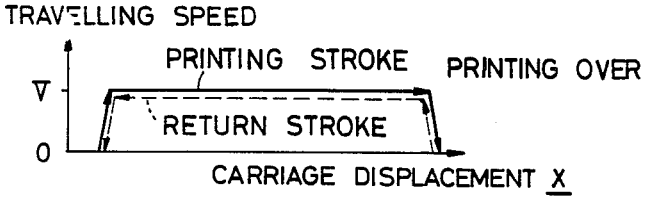
FIG. 13 is a diagram showing the relation between the desplacement and travelling speed of the carriage when the number of characters to be printed is less than the preset value.
Figure 14:
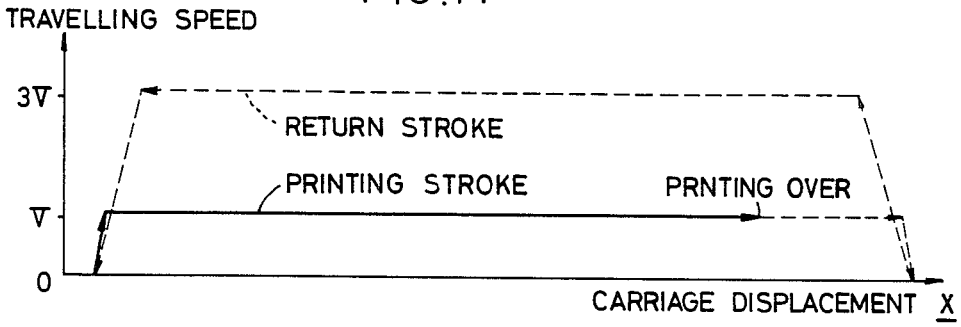
FIG. 14 is a diagram showing the relation between the displacement and travelling speed of the carriage when the number of characters to be printed is equal to or larger than the preset value.

In FIG. 8, the counter circuit 18, the printing character number detecting circuit 19, the comparators 20*a* and 20*b*, etc. are cleared to their initial state. Then the main control 14 operates in response to input data transmitted from a computer (not shown). Upon reception of a printing command signal, the carriage motor control 15 generates a forward rotation signal a to thereby cause the carriage motor 1 to rotate in the forward direction. The rotation of the carriage motor 1 causes the slotted disk 2 to rotate so that the dot sensor 3 produces pulses as shown in FIG. 5, and at the same time the lead screw or shaft 6 is also caused to rotate in the forward direction. At this point of time, normally, the carriage 7 is in its home position at the left end in FIG. 1. However, if the carriage 7 is not in its left home position, the succeeding operations are put in a stand-by state until the carriage 7 comes back to its home position. If the carriage 7 is in its home position, printing is made on the basis of printing data after the carriage 7 leaves its home position, that is after the output of the home sensor 9 is turned off. The printing operation is controlled such that the printing hammer 38 of the printing head 8 is controlled in response to the output pulses of the dot sensor 3 through the printing head control 16 in synchronism with the position of the ridges 39 of the platen 5. In this printing operation, the carriage 7 is caused to travel rightwardly in a forward stroke, at a speed V as shown in FIGS. 13 and 14, through the action of the first groove 40*a* of the lead screw 6.

In parallel with this printing operation, the output pulses of the dot sensor 3 are counted by the counter 18 of FIG. 8, and the number N of the characters to be printed is successively calculated in the printed-character number detection circuit 19 on the basis of the counted value K. The calculated number N of the characters to be printed is compared with a value preset in the comparator 20*a*. In this embodiment, the preset value of the comparator 20*a* is 50 and the manner of how to determine the preset value will be described later. If the comparator 20*a* determines that the number of characters to be printed is less than 50, it outputs a corresponding detection signal to the main control 14. Upon completion of desired printing and upon reception of a return command signal, the carriage 7 is returned to its home position in accordance with the flow chart of FIG. 10 when the printed-character number N is less than the preset value 50 and in accordance with the flow chart of FIG. 11 when the printed-character number N is equal to or larger than the preset value 50.

Figure 15:
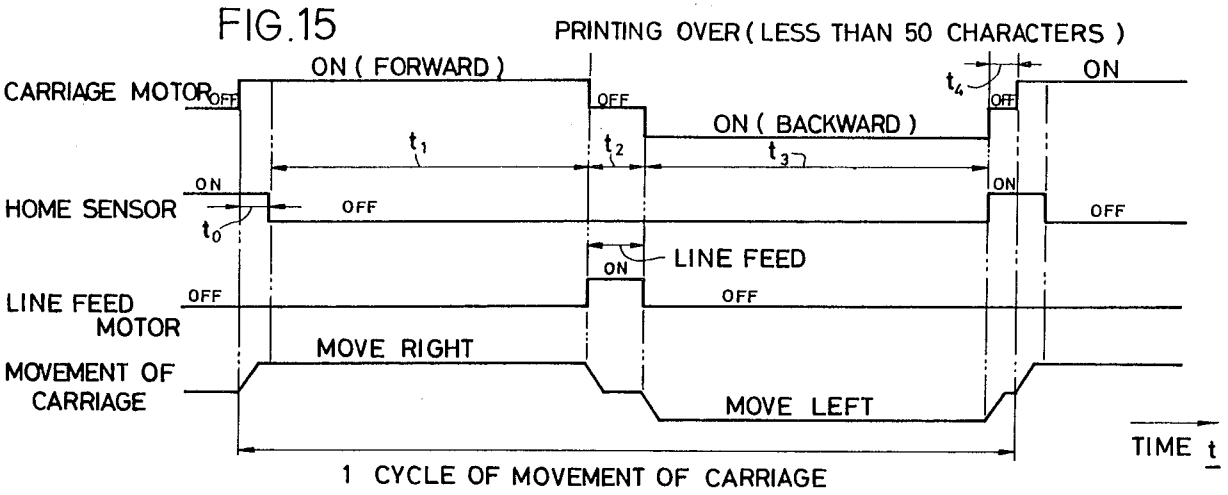
FIG. 15 is a time chart when the number of characters to be printed is less than the preset value.

When the printed-character number N is less than the preset value 50, the carriage motor 1 is once turned off and the line feed is performed in this off period of the carriage motor 1. That is, in FIG. 11, the line feed motor 10 is driven through the line feed motor control 17 so as to drive the line feed rollers 12*a* and 12*b* through the gear train 4. The gear train 4 is constituted by the motor pinion 42, the gear 43, the pinion 44, the line feed gear 45, the gear 47, the idler 48, and the line feed gear 49, as shown in FIG. 3. The line feed rollers 12*a* and 12*b* of FIG. 2 are thus driven through the gear train 4 so that the recording medium 54 is advanced and fed by a predetermined length. Upon completion of line feed, the main control 14 causes the carriage motor control 15 to generate a reverse rotation signal b so that the carriage motor 1 is reversely rotated. Thus, the lead screw 6 or shaft is rotated backward so that the carriage 7 is returned leftwardly in a backward or return stroke toward to its home position along the first groove 40*a*. When the carriage 7 reaches its home position so that the output of the home sensor 9 is turned on, the carriage motor 1 is turned off. That is, when the printed-character number N is less than the preset value 50, the carriage 7 is returned to its home position from the position at which the printing is completed, at the same travelling speed V as that in the printing operation, as shown in FIG. 13. FIG. 15 shows the time chart in one reciprocating cycle of the carriage 7 when the printed-character number N is less than the preset value. Such a mode of operation is referred to as a "first return mode".

Figure 16:
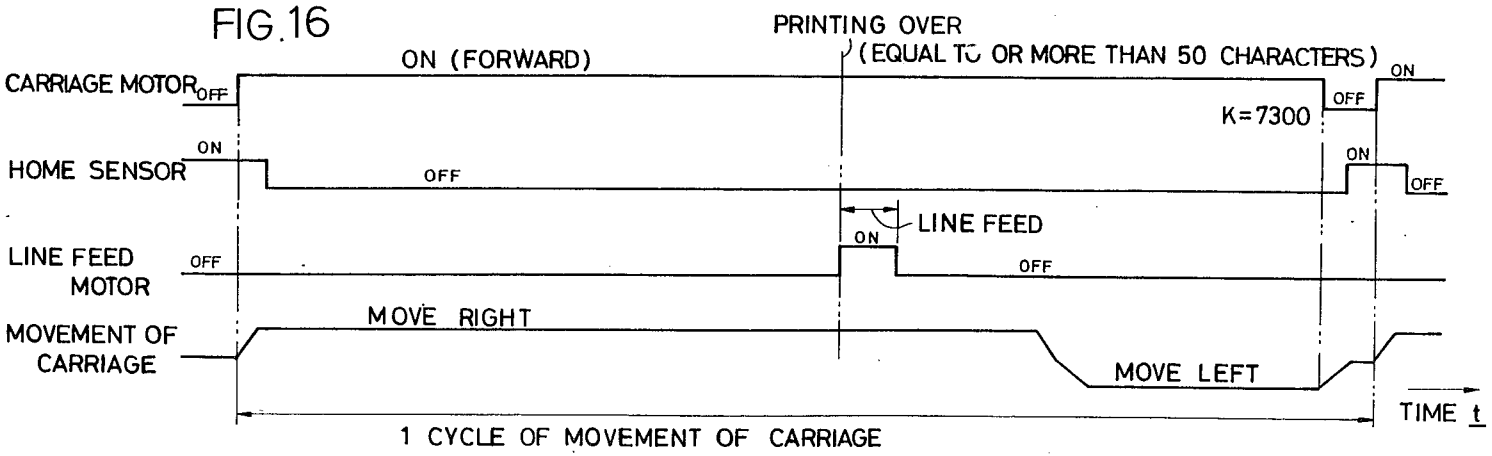
FIG. 16 is a time chart when the number of characters to be printed is equal to or larger than the preset value.

When the printed-character number N is equal to or larger than the preset value 50, the carriage motor 1 is controlled such that it continues the forward rotation as it was even after a return command signal has been received, and line feed is performed in the same manner as in the above-mentioned case. Since the carriage motor 1 continues its forward rotation, the carriage 7 is moved rightwardly through the first groove 40*a* of the lead screw 6 shown in FIG. 1 even after the completion of printing so that the engagement of the engagement member 41 is switched over from the first groove 40*a* to the second groove 40*b* at the right end portion 40*d* (see FIG. 12) and the carriage 7 is returned to its home position through the second groove 40*b* at the speed 3V (see FIG. 14). Even after reception of the return command signal, the counter 18 continues to count the output pulses of the dot sensor 3. The counted value K of the counter 18 is compared in the comparator 20*b* with its preset value. The preset value of the comparator 20*b* is selected to be 7300 in this embodiment. Thus, when the counted value K of the counter 18, after the carriage 7 goes out of its home position, reaches the preset value 7300, the comparator 20*b* is actuated so that the main control 14 causes the carriage motor control 15 to stop the output of the forward rotation signal a to thereby turn the carriage motor 1 off. Although the carriage motor 1 is turned off at a position slightly before the home position, the carriage 7 continues advancing leftward even after the carriage motor 1 is turned off, due to the inertia of the platen 5, the lead screw 6, the carriage 7 per se, etc., and stops when it just comes in its home position. FIG. 16 shows the time chart in one reciprocating cycle of the carriage 7 when the printed-character number N is equal to or larger than the preset value. Although the carriage motor 1 is turned off in the above-mentioned manner in this embodiment taking into consideration the inertia running due to the fact that the carriage 7 is returned with the speed 3V, it is possible to turn the carriage motor 1 off by the signal from the home sensor 9 in the ordinary manner. In the latter case, however, it is necessary to make sure that the carriage 7 does not overrun the region of the home position due to inertia running. This mode of operation is referred to as a "second return mode".

The preset value of the comparator 20a is determined in the following manner.

In the case where the carriage 7 is reciprocated along the path of FIG. 13, the time $T_1$ for one reciprocating cycle of the carriage 7 varies depending on the number N of the characters to be printed. However, when the carriage 7 is reciprocated along the path of FIG. 14, the time $T_2$ for one reciprocating cycle of the carriage 7 is constant regardless of the number N of the characters to be printed and it is about 3 seconds in this embodiment. Accordingly, the number N of the characters to be printed when the time $T_1$ becomes equal to the time $T_2$ is employed as the preset value time $T_1$ and is expressed as follows:

$$T_1 = t_0 + t_1 + t_2 + t_3 + t_4 \ldots \quad (1)$$

where $t_0$ represents the time from the turn-on of the carriage motor 1 to the turn-off of the output of the home sensor 9, $t_1$ the time for printing the N characters after the output of the home sensor 9 is turned on, $t_2$ the time for the off-period of the carriage motor 1 after the completion of printing of the N characters, $t_3$ the time for thereafter effecting reverse rotation of the carriage motor 1, and $t_4$ the time for the off-period of the carriage motor 1 when the motor is switched over from the forward rotation to the backward rotation. Since the time $t_3$ is substantially equal to the sum of $t_0+t_1$, that is $t_3 \div t_0+t_1$ and $t_1$ can be expressed as $t_1=N/M$ on the assumption that the printing speed is M cps (characters per second), the equation (1) can be expressed as follows:

$$T_1 = 2t_0 + 2N/M + t_2 + t_4 \ldots \quad (2)$$

In this embodiment, it is set that M=40 cps, $t_0=0.2$ sec, $t_2=0.2$ ses, and $t_4=0.1$ sec, and when the number N of the characters to be printed is obtained by substituting these values M, $t_0$, $t_2$, and $t_4$ into the equation (2), N=50 can be obtained.

The present invention is not limited to the above-mentioned embodiment, and various modifications in design can be attained.

For example, as to the printing mechanism, the present invention can be applied to another printing mechanism, other than the cross-hammer type printing mechanism, such as a wire dot type printer, a thermal type printer, an electrode stylus type printer, an ink-jet type printer, etc. The means for detecting the number of characters to be printed can be suitably changed depending on the variations of the printing mechanism. For example, a strip of a slotted plate may be provided in parallel with the travelling direction of the carriage 7, with a photo sensor cooperating with the slotted plate which is mounted on the carriage.

According to the present invention, as described above, in a printer in which a carriage is reciprocated through a lead screw and printing is made while the carriage travels only in one of the reciprocating directions, the carriage can be rapidly returned to its home position by selecting the return mode, so that the time required for the carriage to return to its home position becomes shorter, resulting in an improvement in actual printing speed.

What is claimed is:

1. A device for controlling the travelling of a printer head, comprising:

a slidably supported carriage having a printing head mounted thereon and having an engagement member;

a lead screw having a helical guide groove formed on its outer peripheral surface, said engagement member slidably engaging with said guide groove, said guide groove comprising first and second helical grooves wound in opposite directions to each other and connected to each other at their respective opposite end portions so as to form a closed loop, said second groove having a pitch larger than that of said first groove;

a reversible carriage motor connected to rotationally drive said lead screw in forward and backward directions of rotation;

carriage motor control means for selectively generating a forward rotation signal for causing said carriage motor to rotate in the forward direction and a backward rotation signal for causing said carriage motor to rotate in the backward direction;

means for detecting the number of characters to be printed by said printing head for each line of print; and main control means responsive to a print command signal for causing said carriage motor control means to generate said forward rotation signal, said main control means further including means responsive to a return command signal for causing said carriage motor control means to generate either said backward rotation signal or said forward rotation signal, said last-named means determining which of said rotation signals is to be generated in accordance with the position of said printing head along said lead screw, said backward rotation signal being selected when the number of printed characters detected by said detecting means is less than a preset value, said forward rotation signal being selected when the number of printed characters detected by said detecting means is equal to or larger than said preset value.

2. A device according to claim 1, in which the ratio of the pitch of said second groove to the pitch of said first groove is 3:1.

3. In a printing apparatus having a printing head reciprocable from a home position through forward and return translational strokes of travel for printing lines of characters on a recording medium during only the forward strokes of travel: detecting means for detecting the number of characters to be printed for each line of print; and driving means coacting with the detecting means for reciprocably driving the printing head from the home position through forward and return translational strokes, the driving means comprising a shaft mounted to undergo rotation in forward and backward directions and having on its outer peripheral surface a helical guide groove comprised of first and second heical groove portions wound in opposite directions to each other along the length of the shaft and connected to one another at their respective opposite end portions so as to define a closed loop helical guide groove, the second helical groove portion having a pitch larger than that of the first helical groove portion, means slidable in and along the closed loop helical guide groove for effecting translational travel of the printing head in forward and return strokes in accordance with the rotation of the shaft, and control means for operating the shaft in a first return mode in which the shaft is rotated in the backward direction to effect return of the printing head to the home position by the first helical groove portion when the number of characters to be printed on a line is detected by said detecting means to be less than a predetermined value and for operating the shaft in a second return mode in which the shaft is rotated in the forward direction to effect return of the printing head to the home position by the second helical groove portion when the number of characters to be printed on a line is detected by said detecting means to be equal to or greater than the predetermined value.

4. A printing apparatus according to claim 3; wherein the driving means includes a reversible motor connected to rotationally drive the shaft in forward and backward directions of rotation, and the control means comprises means for controlling the operation of the motor to accordingly effect operation of the shaft in the first and second return modes.

5. A printing apparatus according to claim 3; wherein the detecting means includes means for producing a detection signal whenever the detected number of characters to be printed for each line is less than the predetermined value; and the control means includes means receptive of the detection signal for operating the shaft in the first return mode.

6. A printing apparatus according to claim 3; wherein the control means includes means for initiating the first return mode of operation of the shaft at a time when the printing head is at a position along its forward stroke of travel at which the last character is to be printed for that line of print.

7. A printing apparatus according to claim 6; wherein the control means includes means for initiating the second return mode of operation of the shaft at a time when the printing head is at the extreme forwardmost position along its forward stroke of travel.

8. A printing apparatus according to claim 3; wherein the control means includes means for initiating the second return mode of operation of the shaft at a time when the printing head is at the extreme forwardmost position along its forward stroke of travel.

* * * * *